US005143749A

United States Patent [19]

Wise et al.

[11] Patent Number: 5,143,749

[45] Date of Patent: Sep. 1, 1992

[54] METHOD FOR TREATING A GRAPHITE OR CARBON BODY TO FORM A PROTECTIVE COATING

[75] Inventors: Francis E. Wise, Medina, Ohio; Philip D. Coleman, Columbia, Tenn.

[73] Assignee: UCAR Carbon Technology Corporation, Danbury, Conn.

[21] Appl. No.: 725,892

[22] Filed: Jul. 1, 1991

Related U.S. Application Data

[63] Continuation of Ser. No. 419,332, Oct. 10, 1989, abandoned.

[51] Int. Cl.[5] ..... B05D 3/02; B05D 5/12

[52] U.S. Cl. ..... 427/45.1; 427/113; 427/374.1

[58] Field of Search ..... 427/45.1, 113, 112, 427/372.2, 374.1, 398.3, 443.1

[56] References Cited

U.S. PATENT DOCUMENTS

| | | | |
|---|---|---|---|
| 2,881,100 | 4/1959 | Hardman | 427/113 |
| 3,222,217 | 12/1965 | Grabmaier | 427/45.1 |
| 3,572,286 | 3/1971 | Forney | 427/45.1 |
| 3,689,315 | 9/1972 | Quentin | 427/113 |
| 3,762,941 | 10/1973 | Hou | 427/45.1 |
| 3,852,197 | 12/1974 | Lorkin et al. . | |
| 4,103,046 | 7/1978 | Taniguchi | 427/113 |
| 4,226,207 | 10/1980 | Genev et al. | 427/113 |
| 4,255,466 | 3/1981 | Natsume et al. | 427/113 |
| 4,292,345 | 9/1981 | Kolesnik et al. | 427/113 |
| 4,726,995 | 2/1988 | Chiu . | |

*Primary Examiner*—Marianne Padgett

[57] ABSTRACT

A process for treating an electrode to form a protective coating comprising applying a precursor of an impregnate material to the surface, controlling the depth of penetration, induction heating the surface under controlled conditions of power, frequency and relative velocity to bring the surface to the treat temperature and quench cooling the surface.

10 Claims, 2 Drawing Sheets

METHOD FOR TREATING A GRAPHITE OR CARBON BODY TO FORM A PROTECTIVE COATING

This application is a Continuation of prior U.S. application Ser. No. 419,332 Filing Date Oct. 10, 1989, now abandoned.

FIELD OF THE INVENTION

The present invention is directed to a method for treating a graphite or carbon body, such as an electrode, to form a protective coating at the surface of the graphite or carbon body.

BACKGROUND OF THE INVENTION

Carbon and graphite electrodes are often coated with various substances to enhance their properties. For example, oxidation-retardant substances are impregnated into electrodes or applied to electrode surfaces to inhibit oxidation during use of the electrode. Such an oxidation-retardant system is disclosed in U.S. Pat. No. 4,726,995. Generally, application of coating materials to electrode surfaces involves application of a precursor material to the surface of the electrode and then heating the electrode to transform the precursor material into the final protective material. For example, in the process of U.S. Pat. No. 4,726,995, the electrode is impregnated with a liquid composition comprising a phosphate compound, a halide-containing compound and a solvent for the halide containing compound such as water. The entire electrode body is then heated to a treat temperature of between 500° C. and 600° C., in a conventional gas oven for a period of between 1 and 3 hours, to convert the impregnate into an insoluble phosphate compound.

The prior art coating method of impregnating the entire electrode body with a coating precursor, and then heating the entire electrode body to the required temperature for converting the precursor into the final protective coating is expensive, time consuming and above all wasteful of impregnate material. U.S. Pat. No. 4,726,995 also teaches rolling the electrode in a bath to impregnate the electrode to a limited depth before heating in order to provide savings in the quantity of coating solution applied. However, when the electrode is heated, the entire electrode body is heated, even that portion not impregnated with coating solution, resulting in a significant waste of thermal energy to heat unnecessary portions of the electrode.

In addition, the prior art method does not lend itself to automation and requires a significant investment in time to cure each electrode separately in a batch type operation. As discussed above, the entire electrode mass is heated in order to heat the impregnate in the electrode to its thermal conversion temperature (hereinafter referred to as the "treat" temperature). Heating the entire electrode to the treat temperature requires several hours. Furthermore, the gas ovens typically used for heating electrodes require an extensive investment in time to load and unload the furnace. Following conversion of the precursor material, the electrode must then be cooled to ambient temperature so as to permit handling and stacking. This may again involve several hours.

The end result is that the prior art technique is both time and energy intensive, which translates into excessive energy costs, excessive capital equipment requirements, and increased inventory overhead.

OBJECTS OF THE INVENTION

It is therefore an object of the invention to provide a method for treating a graphite or carbon body such as an electrode to form a protective coating of predetermined depth at the surface of the electrode.

It is also an object of the invention to provide a method wherein the time required to process the electrode to form the coating, including application of a coating precursor, thermal treatment and cooling is significantly less than prior art methods.

It is further an object of the invention to provide a method for processing graphite or carbon electrodes with a protective coating in a continuous manner without interruption.

Other objects of the invention will become evident in the description that follows.

SUMMARY OF THE INVENTION

The preferred embodiment of the present invention is directed to a method for treating graphite or carbon bodies in sequence to form a protective coating at the surface of each body which comprises:

(a) contacting the surface of each graphite or carbon porous body with a precursor material containing a phosphate compound to cause said precursor material to penetrate into said graphite or carbon porous body;

(b) controlling the depth of penetration of the precursor material into each graphite or carbon body so that only a predetermined region of the body extending from its surface to a depth of between about ⅛ inch to about ½ inch is impregnated with precursor material;

(c) placing each impregnated carbon body on a moving conveyor assembly line oriented to pass the impregnated region of each graphite or carbon body adjacent a high frequency induction heating coil so as to preferentially heat the impregnated surface;

(d) controlling the power of the induction heating coil, the frequency of the coil, and the relative velocity between the impregnated surface and the coil such that the impregnated region is heated up to a peak of 600° C. for forming an insoluble phosphate compound from the said precursor material in the impregnated region of each graphite or carbon body;

(e) quench cooling the impregnated surface of the carbon body while on-line on the moving conveyor assembly immediately following said induction heating so as to rapidly withdraw heat from the impregnated region before substantial heat conduction occurs further into the interior of the graphite of carbon body; and (f) serially removing each body from said moving assembly line. conduction of heat occurs further into the interior of the body.

In the method of the present invention, the precursor material is permitted by capillary action to penetrate only a controlled region at the surface of the electrode. This controlled region extends from the superficial external surface to a predetermined surface depth. Graphite electrodes are known to be porous and will permit a liquid coating precursor to penetrate through its external surface into its open pores. The depth of penetration should be limited to no more than the grain size of the electrode and typically between about ⅛ inch to about ½ inch depending upon the applied precursor composition. Precursor compositions are generally aqueous solutions. Penetration of the precursor material into the region near the surface is preferred, as it provides an adherent coating which is resistant to thermal shock. Additional penetration of the precursor material further into the interior of the electrode is unnecessary and wasteful. If penetration is too deep, the applied heat may be insufficient to raise the electrode temperature to the treat temperature necessary to cure the precursor. Additionally, if precursor material infiltrates too deeply into the interior of the electrode and remains uncured, the uncurred material may cause corrosion of the graphite electrode holder which would defeat the objective for the precursor.

In accordance with the method of the present invention, only the region near the surface of the electrode is impregnated with precursor material, resulting in significant savings in the amount of precursor material used, particularly in comparison to prior art methods where the entire electrode mass is infiltrated. In a typical practice of the invention, the precursor material requirements are from only 2 to 3 percent of that required for full infiltration of the electrode. In addition, full impregnation requires immersion in a high pressure autoclave, typically containing a working volume of solution substantially larger than the volumes of the electrodes to be treated (1000 gallons may be typical for commercial operation). The controlled degree of solution infiltration in the present invention can be practiced in a non-pressurized pan with only a working volume of 50 gallons of precursor solution or less. In general, the particular method for applying the precursor material to the surface can involve any suitable method wherein only the surface is treated without full infiltration of the electrode mass. These include, for example, spraying, rolling and painting. The preferred method is to roll the electrode in a shallow bath of the precursor material.

After application of the precursor material, the impregnated surface region of the electrode is heated to a temperature in excess of the treat temperature required to chemically transform the coating precursor into a cured coating which is preferably insoluble. This is accomplished by passing the impregnated surface region of the electrode adjacent a high frequency induction coil at relatively high power. Preferably, this is accomplished by passing the electrode length wise through an annular induction coil at a controlled velocity. The power of the induction coil, the frequency of the induction coil, and the velocity at which the electrode passes through the coil is controlled such that the treated surface region of the electrode is heated at or above the treat temperature sufficient to thermally convert the precursor material into a cured coating.

In the method of the invention, the surface of the electrode is heated quickly to the treat temperature for a time sufficient to convert the precursor to a cured, preferably insoluble, coating and then immediately quench cooled with a fluid coolant to control the withdrawal of heat from the electrode so as to permit continuous processing of successor electrodes without interruption. The result of practicing the method of the invention is that only the treat surface of each electrode is processed since the interior of the electrode is relatively unheated the energy requirement, and thus the energy costs, of the method of the invention are significantly reduced. A savings in time is also achieved since the total heat content of the electrode after heating is much lower when compared to prior-art methods and most of the heat content is concentrated near the surface of the electrode and withdrawn before passing into the interior of the electrode. The rapid quench cooling prevents the resident heat in the electrode following thermal conversion from conducting into the interior of the electrode. If heat were permitted to conduct into the interior of the electrode a significant amount of time would be required to permit the electrode to cool down to ambient temperature. This would prevent continuous processing of the electrode. Quench cooling is preferably accomplished with a liquid coolant such as water, atomized water, or any other liquid medium and is preferably applied by liquid or atomized spray in a chamber located contiguous to the heating chamber.

Accordingly, a principle advantage of the present invention is the significant reduction in the total time required to process an electrode thereby permitting the electrodes to be successively processed in a continuous and semi-automated fashion. Typically, the process time according to the method of the invention is less than about one-shift (less than one day) as compared to about one week for prior art methods. This time savings also results in a significant reduction in costs due to reduced equipment needs. In addition, the time reduction allows a reduction of inventory of finished electrodes, and allows a quicker response to changing requirements of the market.

DESCRIPTION OF THE INVENTION

Figure 1:
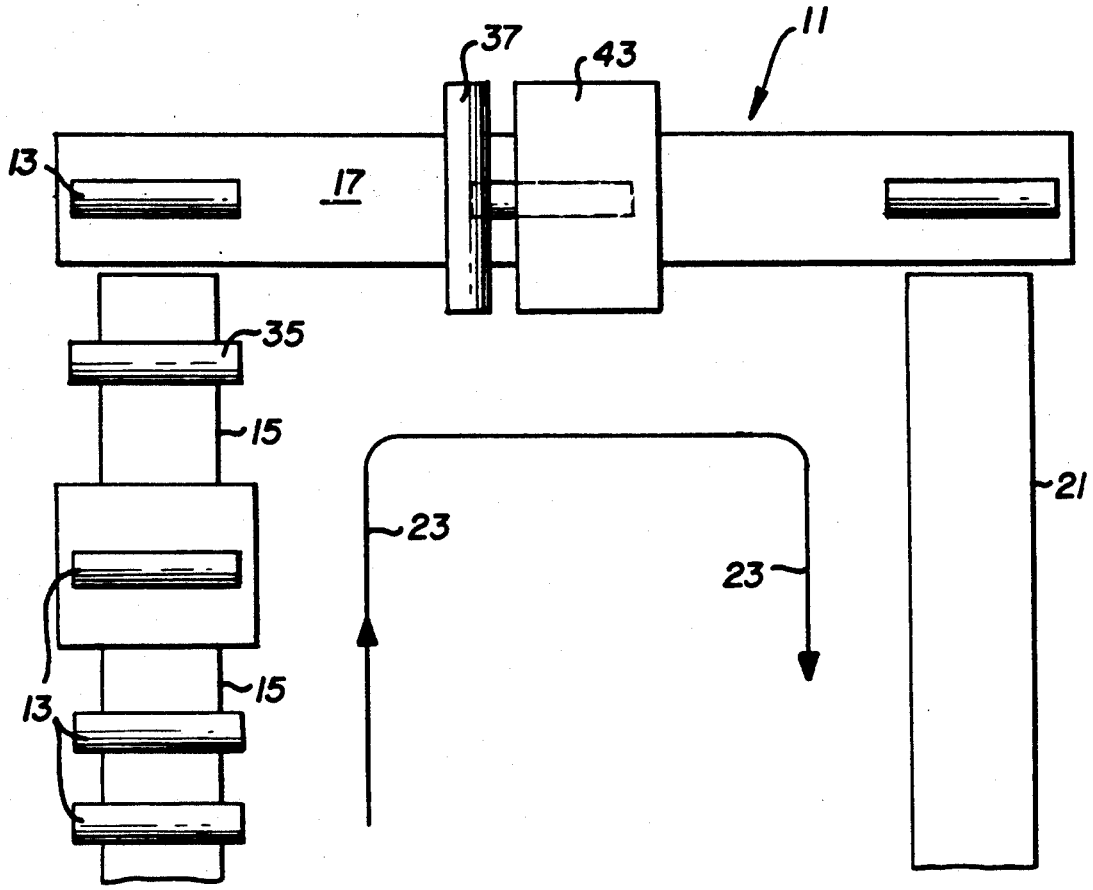
FIG. 1 is a schematic view of an assembly for practicing the method of the invention.

FIG. 1 illustrates a preferred assembly 11 for practicing the invention. In the illustrated assembly 11, a multiple number of electrodes 13 are advanced in succession by a conveyor or conveyor belt assembly 15, 17 and 21 for continuous processing along a selected process path indicated by arrow 23. Each carbon or graphite electrode 13 is sequentially advanced by conveyor 15 through a coating station 22, where each electrode is coated with a coating precursor. Conveyor 17 is arranged transverse to conveyors 15 and 21 so that each electrode 13 will pass longitudinally through the curing station 37 before being rerouted by conveyor 21 in the original feed direction for stacking.

Figure 2:
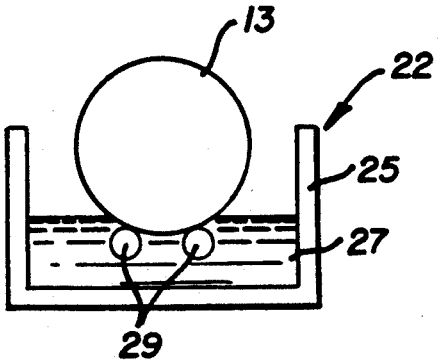
FIG. 2 is a cross-sectional view of the coating assembly in FIG. 1 for applying the coating precursor to the surface of the electrode.

The coating station 22 as shown in FIG. 2 includes a receptable 25 containing a shallow bath 27 of precursor coating solution. The electrode 13 is partially suspended above the bath 27 by support rollers 29 which may be adjusted by means (not shown) to control the depth of immersion of the electrode in the bath 27. The electrode 13 is also rotated (by means not shown) along its longitudinal axis to uniformly immerse the circumference of the electrode 13 in the shallow bath 27. The speed of rotation of the electrode may also be adjusted to control the rate of penetration of the precursor into the electrode 13.

Preferred coating precursor materials used in the bath are those which form antioxidant surfaces upon the electrode, such as disclosed in U.S. Pat. No. 4,726,995, which is hereby incorporated by reference. These precursors are typically solutions containing at least one phosphate-containing compound, at least one halide-containing compound present in an amount between about 1 wt. % and 5 wt. %, and at least one solvent, usually water, for the phosphate containing compound.

Referring again to FIG. 1, after treating the electrode 13 with coating precursor in the coating station 22, the electrode 13 is advanced to a pretreatment station 35 to remove excess moisture from the electrode before passage to the curing station 37. The pretreatment station 35 may be represented simply by a predetermined length of conveyor sufficient to permit excess moisture on the surface of the electrode 13 to drip off or alternatively, a dryer may be used. The electrode 13 is then passed by conveyor 17 length wise through the curing station 37 at a controlled velocity. Curing station 37 comprises a high frequency induction coil(s) (not shown) and standard auxiliary equipment (not shown) to apply power to the induction coil under operator controlled conditions of power and frequency as well as optional auxiliary noise abatement equipment. The surface of the electrode is heated to the appropriate treat temperature necessary to convert the coating precursor to a cured coating. The high frequency coil in curing station 37 is preferably an annular coil which is designed to give the highest power density without overheating the precursor material.

The frequency of the induction coil, the power applied to the induction coil and the relative velocity of the electrode 13 passing through the curing station 37 are controllably selected such that energy is introduced into the electrode in a time interval which is short compared with the thermal diffusion time for heat to penetrate significantly into the interior of the electrode. Stated otherwise, sufficient energy must be introduced in a relatively short time interval sufficient to cause thermal conversion of the precursor material while most of the energy is still resident in the impregnated region confined near the surface of the electrode, i.e., before the heat diffuses by conduction into the interior of the electrode. Recognizing that thermal diffusivity governs the speed at which a heat wave travels to the interior of the electrode, it is necessary to reverse the direction of heat transfer as soon as possible after thermal conversion of the coating and before heat is significantly transferred to the interior of the electrode. Accordingly, the electrode 13 is advanced without interruption from the curing station 37 directly into a cooling station 43 with the cooling station 43 located contiguous to the curing station 37. The cooling station 43 operates to rapidly quench each electrode 13 with a fluid coolant.

The cooling station 43 preferably comprises a series of spray rings (not shown) which sprays a cooling fluid, e.g. a compressed gas such as air, and/or water upon the surface of the electrode. Preferably, the cooling fluid is water which has been atomized through compressed air spray atomizers. The electrode 13 is preferably advanced without interruption from the cooling station 43 with any remaining heat in the electrode allowed to dissipate before passing onto conveyor 21.

Figure 3:
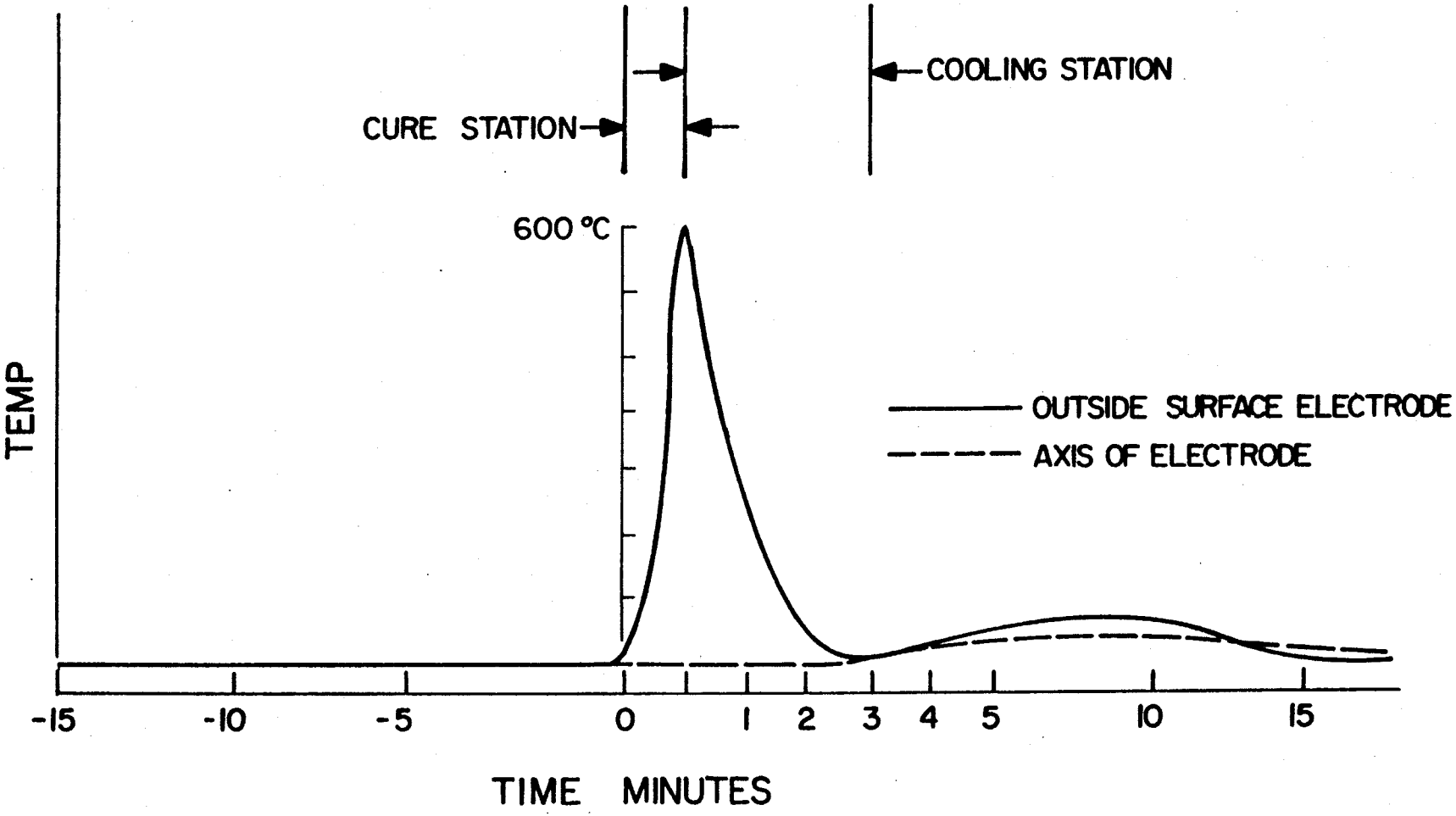
FIG. 3 is a temperature-time profile illustrating the process characteristic of the invention for a typical commercially sized graphite electrode.

The temperature time profile of FIG. 3 illustrates the continuous nature of the process of FIG. 1 with the surface of each electrode 13 passing through both the curing station and the cooling station in under 3 minutes. The electrode 13 is advanced to the coating station 22 at minus 15 minutes i.e., 15 minutes prior to start of the curing operation. The temperature at the surface of the electrode 13 is then raised from ambient temperature to a peak of 600° C. in one-half minute. At such time the surface temperature is immediately reduced by quench cooling within a period of one half additional minute to less than 80% of the peak surface temperature. The total cooling time to restore the electrode surface to ambient temperature is approximately 2.5 minutes. The minor temperature inversion at the electrode surface following the quench-cool period is attributable to residual heat. In a total of fifteen minutes (from time "o") following entrance to the cure station the electrode 13 is ready to be stacked on a pallet. Thus the total processing time for each electrode 13 may be as short as thirty minutes.

The invention will now be illustrated by specific examples.

EXAMPLE IA

This example illustrates application of the precursor material to electrode surface.

The depth of infiltration was measured by ash pattern testing which is well known to those skilled in the art. For this test, electrodes 16 inches in diameter, 72 inches long, and weighing 850 pounds were used.

The electrodes were rolled on a lathe type apparatus about their horizontally disposed center axis at 1.2 rpm. The lower surface of the electrode was immersed in a bath of an aqueous solution of oxidation retardant materials 1 inch below the surface of the bath. The length of rolling time was varied at 10, 30, 60, and 120 minutes. An ash pattern method produced depth penetration versus time measurements of ¼" in 10 minutes, 5/16" in 30 minutes, ⅜" in 60 minutes, and 7/16" in 120 minutes. For 30 electrodes treated in the above manner for 60 minutes, there was a solution pick-up ranging form 0.24 to 0.43, for an average of 0.35 wt. % solution to weight of electrode.

EXAMPLE IIA

This example illustrates the heating step of the invention.

An apparatus of the invention was constructed using an induction system with a power source of 3,000 Hertz, and 500 kilowatts, and a horizontally mounted induction coil, 20 inches inside diameter and 18 inches long, with 3 sections of 8 coil turns per section. The apparatus also comprised an electrode conveyor system, and a conventional fume system.

For these tests, the cure depth was set at ½" and the electrodes successively heated to or above a treat temperature of 550° C. Suitable feed rates (velocity of the electrode through the coil) and the operating powers to achieve these conditions are shown in Table II below.

TABLE II

| Test | Power (KW) | Feed Rate (ft/min) |
|---|---|---|
| A | 335 | ½ |
| B | 535 | 1 |

The electrode in test B was allowed to cool in stagnant air. A near equilibrium temperature between 350° and 400° C. was achieved in 6 minutes. 50° C. was reached in eight hours.

EXAMPLE IIB

An apparatus for practicing the method of the invention was constructed using an induction system with a power source of 10,000 Hertz, and 1000 kilowatts, and a horizontally mounted induction coil, 19½ inches inside diameter and 12 inches long, with 3 sections of 3 coil turns per section. The apparatus also comprised an electrode conveyor system, and a conventional fume system.

For these tests, the electrodes were treated to a depth of ⅜" and heated to or above a treat temperature of 570° C. Suitable operating conditions were found to be an operating power of 900 to 920 KW at an electrode velocity of 2 feet per minute.

The electrodes were immediately cooled using water and a compressed air atomizer system to an average temperature between 120° C. and 150° C. in 10 minutes. The electrodes then cooled in stagnant air to 50° C. in four hours.

While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

We claim:

1. A method for treating graphite or carbon porous bodies in sequence to form a protective coating at the surface of each body comprising the steps of:

(a) contacting a surface of each graphite or carbon porous body with a precursor material containing a phosphate compound to cause said precursor material to penetrate into said graphite or carbon porous body;

(b) controlling the depth of penetration of the precursor material into each graphite or carbon body so that only a predetermined region of the body extending from its surface to a depth of between about ⅛ inch to about ½ inch is impregnated with precursor material;

(c) placing each impregnated carbon body on a moving conveyor assembly line oriented to pass the impregnated region of each graphite or carbon body adjacent a high frequency induction heating coil so as to preferentially heat the impregnated surface;

(d) controlling the power of the induction heating coil, the frequency of the coil, and the relative velocity between the impregnated surface and the coil such that the impregnated region is heated up to a peak of 600° C. for forming an insoluble phosphate compound from said precursor material in the impregnated region of each graphite or carbon body;

(e) quench cooling the impregnated surface of the carbon body while on-line on the moving conveyor assembly immediately following said induction heating so as to rapidly withdraw heat from the impregnated region before substantial heat conduction occurs further into the interior of the graphite of carbon body; and (f) serially removing each body from said moving assembly line.

2. A method as defined in claim 1 wherein said body is carbon or graphite electrode.

3. A method as defined in claim 2 wherein said impregnated surface is quench cooled by spraying the surface with a fluid coolant.

4. A method as defined in claim 3 wherein said fluid coolant is water.

5. A method as defined in claim 3 wherein said quench cooling occurs in a cooling station located continuous to the location of said high frequency induction heating coil.

6. A method as defined in claim 5 wherein a plurality of electrodes are advanced successively and substantially without interruption for performing steps (a) through (e) on a substantially continuous production line.

7. A method as defined in claim 6 wherein said electrodes are advanced by a series of conveyors such that the electrodes are advanced in succession in a first direction with the longitudinal axis of each electrode transverse to said first direction and are then redirected in a second direction substantially perpendicular to said first direction such that the longitudinal axis of each electrode is aligned parallel to said second direction.

8. A method as defined in claim 7 wherein said high frequency induction heating coil is annular in cross section and aligned with said second direction such that each electrode passes longitudinally through said coil.

9. A method as defined in claims 5 or 8 wherein each electrode is treated with precursor material by partially submerging the electrode in a bath of precursor solution while simultaneously rotating the electrode.

10. A method as defined in claim 9 wherein each electrode is submerged in said bath of precursor material to a depth of between about ⅛ inch to about ½ inch.

* * * * *